United States Patent [19]

Shewchuk

[11] Patent Number: 4,721,306

[45] Date of Patent: Jan. 26, 1988

[54] HOCKEY SAFETY NET

[76] Inventor: James G. Shewchuk, 1988 Pacific Avenue, Winnipeg, Manitoba, Canada, R2R 0G4

[21] Appl. No.: 685

[22] Filed: Jan. 5, 1987

Related U.S. Application Data

[63] Continuation-in-part of Ser. No. 851,967, Apr. 14, 1986, abandoned, which is a continuation-in-part of Ser. No. 709,770, Mar. 8, 1985, abandoned.

[30] Foreign Application Priority Data

Apr. 24, 1984 [CA] Canada ..... 452636

[51] Int. Cl.[4] ..... A63B 63/00

[52] U.S. Cl. ..... 273/127 B

[58] Field of Search ..... 273/127 R, 127 B, 1 B, 273/26 A, 55 D, 410, 411, 177, 25; 248/160; 52/113; 403/2, 118, 129, 120, 123, 29, 166; 446/27, 28, 29; 404/10, 11

[56] References Cited

U.S. PATENT DOCUMENTS

| | | | |
|---|---|---|---|
| 1,435,363 | 11/1922 | Wood | 52/113 |
| 1,443,204 | 1/1923 | Bernstein | 52/113 |
| 2,098,388 | 11/1937 | Hruska | 52/113 |
| 2,103,410 | 12/1937 | Frei, Jr. | 404/10 |
| 2,127,980 | 8/1938 | Niemann | 403/166 |
| 3,478,714 | 11/1969 | Keats | 404/10 |
| 3,979,120 | 9/1976 | Dietrich | 273/127 B |

*Primary Examiner*—Richard C. Pinkham
*Assistant Examiner*—T. Brown
*Attorney, Agent, or Firm*—Adrian D. Battison; Stanley G. Ade

[57] ABSTRACT

A goal structure for a game such as ice hockey provides a safety net which is constructed in the conventional form to provide a rigid pair of posts and cross-bar together with net supports extending rearwardly of the posts. The goal structure can be attached to the playing surface or ice by an assembly mounted wholly within the posts comprising a spring and cable, the cable passing axially of the post through an apertured guide block at the end of the post into an anchor bolt within the ice. An upper end of the spring is movable axially to apply and release the spring tension either by a transverse pin which extends into slots in the wall of the post or by an axial pin which can be held in a tensioned position by a latch. The anchor bolt in the ice allows the post to slide sideways across the ice. A plug can be placed in the ice surface when the post is removed to prevent water entering the fixture when flooding.

11 Claims, 5 Drawing Figures

HOCKEY SAFETY NET

This application is a continuation-in-part of application, Ser. No: 851,967, filed Apr. 14, 1986 and now abandoned which is in turn a continuation-in-part of application, Ser. No: 709,770, filed Mar. 8, 1985 and now abandoned.

BACKGROUND OF THE INVENTION

This invention relates to a goal structure for a game such as hockey which comprises a pair of goal posts interconnected by a cross bar at the upper end in which the posts are normally attached rigidly to the playing surface.

Many sports which use a goal structure of this type and particularly ice hockey, are high velocity, high energy games in which collisions and impacts are an important part of the game and hence unavoidable. Collisions with other players do not generally cause serious injury since the player is fairly flexible and therefore in the collision both players tend to deform to some extent thus avoiding the sort of injury that occurs in contact with a rigid object.

Collisions with the boards surrounding the playing surface can be more damaging since these are rigid, but they have no projections and thus serious injuries are very uncommon.

However, the goal posts and goal structure are generally rigid and include projections or narrow structures which can cause serious injury. This is overcome in hockey played by younger children by merely placing the rigid goal frame and net loosely on the playing surface so that whenever it is contacted by a player it simply moves away from the original location and no damage is caused.

However, this becomes unsatisfactory as the players become older and more skilled since the net can be very easily move away from its location even when not impacted and thus the game has to come to a halt.

Attempts have been made to overcome this problem. In one attempt disclosed in European Application No. 123564 (Meggs) which is currently used in a number of countries and in Olympic competition is the use of magnetic plates at the ice surface which provide a vertical force on a pin on the post drawing it into a recess in the ice. This gives holding force for the goal posts but of course once the magnetic force is overcome they break away under impact. The disadvantage of this system is that it is very expensive in view of its complexity and in addition it is difficult to balance the amount of retaining force to prevent injury and yet avoid the nets breaking away during normal play and particularly at a time of frenetic activity around the net when goals are likely.

Furthermore the restraining force provided by this device is at a maximum before any displacement of the post occurs and then drops to zero once displacement has taken place. Thus the post is rigid and stationary without any deflection or displacement at the time of impact when injury is most likely.

Various other proposals have been made in patents for sprung arrangements which allow the goal posts to flex and, for example, U.S. Pat. Nos. 2,449,708 and 2,525,304 (both to Lindsay) and Canadian Pat. No. 996,594 (Dietrich) show relevant attempts. However, the proposals in these patents have not been taken up at all since they clearly vary the shape and structure of the goal when its shape and structure is an important part of the game which cannot be changed without altering the characteristics of the game.

SUMMARY OF THE INVENTION

It is an object of the present invention, therefore, to provide an improved goal structure of this type which can provide the necessary resilience while not altering the characteristics and structure of the goal itself.

According to the invention, therefore, there is a goal structure for attachment to an ice surface comprising a pair of vertical goal posts each having a hollow interior and arranged for attachment of a lower end thereof to the ice surface, a cross-bar rigidly interconnecting said the goal posts at upper ends thereof in spaced upstanding position and a net support member extending rearwardly of and between the posts and rigidly attached to said lower ends thereof so that the goal structure defines a rigid body for supporting a net rearwardly of a face defined between the goal posts which can sit on the ice surface upon a base defined by the lower ends of the posts and an underside of said net support member, and a kit of parts for attachment of the goal structure to the ice surface, said kit comprising first and second spring means for mounting within the hollow interior of respective ones of said posts, first attachment means for attaching one end of each of said spring means within said goal post to the goal structure and second attachment means for attaching an opposed end of each of said spring means to the ice surface through the other end of the goal post, said second attachment means comprising a flexible cable having one end attached to the opposed end of the spring means, a receiving member for engagement in the ice surface, releasable fastening means attached to an opposed end of the cable and arranged for readily releasable engagement to said receiving member directly beneath said lower end of the post, and guide block means in said lower end of the goal post defining a narrow aperture through which the cable passes to said fastening means such that when attached, the spring means can apply spring tension between the goal post and the ice surface through the cable, said receiving member defining an upper surface which is at a height no greater than that of the ice surface and which is shaped such that the guide block means can move freely laterally thereto whereby a sufficient impact force on the goal post causes the goal post to move laterally relative to the ice surface and to pull said cable through said block means against spring tension.

It will be appreciated therefore that a structure of this type can provide the necessary flexibility, that is it can break away from the fixed position under severe impact and yet the goal structure itself is substantially unchanged with the springs and coupling arrangements mounted substantially wholly within a post and therefore do not interfere in any way with the normal movement of the pack or projectile.

In addition, the spring force can be varied by providing different springs or an adjustment device and thus the impact force can be varied for different ages or sizes of player.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
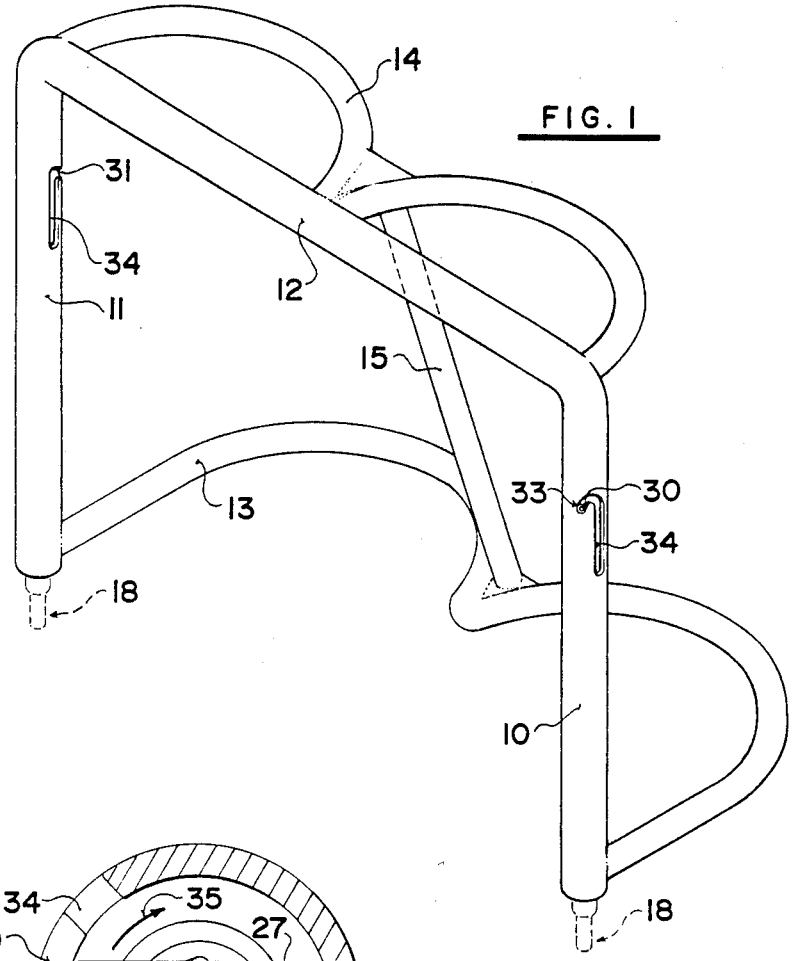
FIG. 1 is an isometric view of a hockey net according to the invention.

The hockey net or goal structure illustrated in FIG. 1 is only one example since it will be appreciated that a goal structure of this type could be used in other games, but it is particularly useful for ice hockey where the velocity of movement of the players is very high and their stability reduced.

The goal structure is substantially the same as the conventional structure in that it comprises a pair of goal posts 10 and 11 in the form of a hollow pipe which are integrally connected to a cross-bar 12 at the upper end which together form the goal face. Rearwardly of the goal face is the net supporting structure which comprises rearwardly and inwardly extending net support 13 which lies against the playing surface and is rigidly attached to the goal posts at the bottom end. A further upper support 14 is positioned at the top of the net and again is rigidly attached to the goal posts together with a downwardly and rearwardly extending strut 15 which connects to the centre of the bottom net support 13 to provide a substantially rigid structure which does not collapse on impact and which can slide across the ice surface on the bottom of the posts and on the undersurface of the net support 13.

The details of the net support arrangements are arranged to conform to standard hockey nets and any rules which may apply.

As explained previously, a conventional construction of this type can either rest freely on the ice when young children are playing or alternatively, can be rigidly affixed to the ice by pins which extend upwardly from the ice attached to nuts secured to the concrete floor beneath the ice or in a more recent development, can be mounted on magnets in the ice playing surface.

However, the invention provides an improved mounting arrangement as will be described hereinafter.

Figure 2:
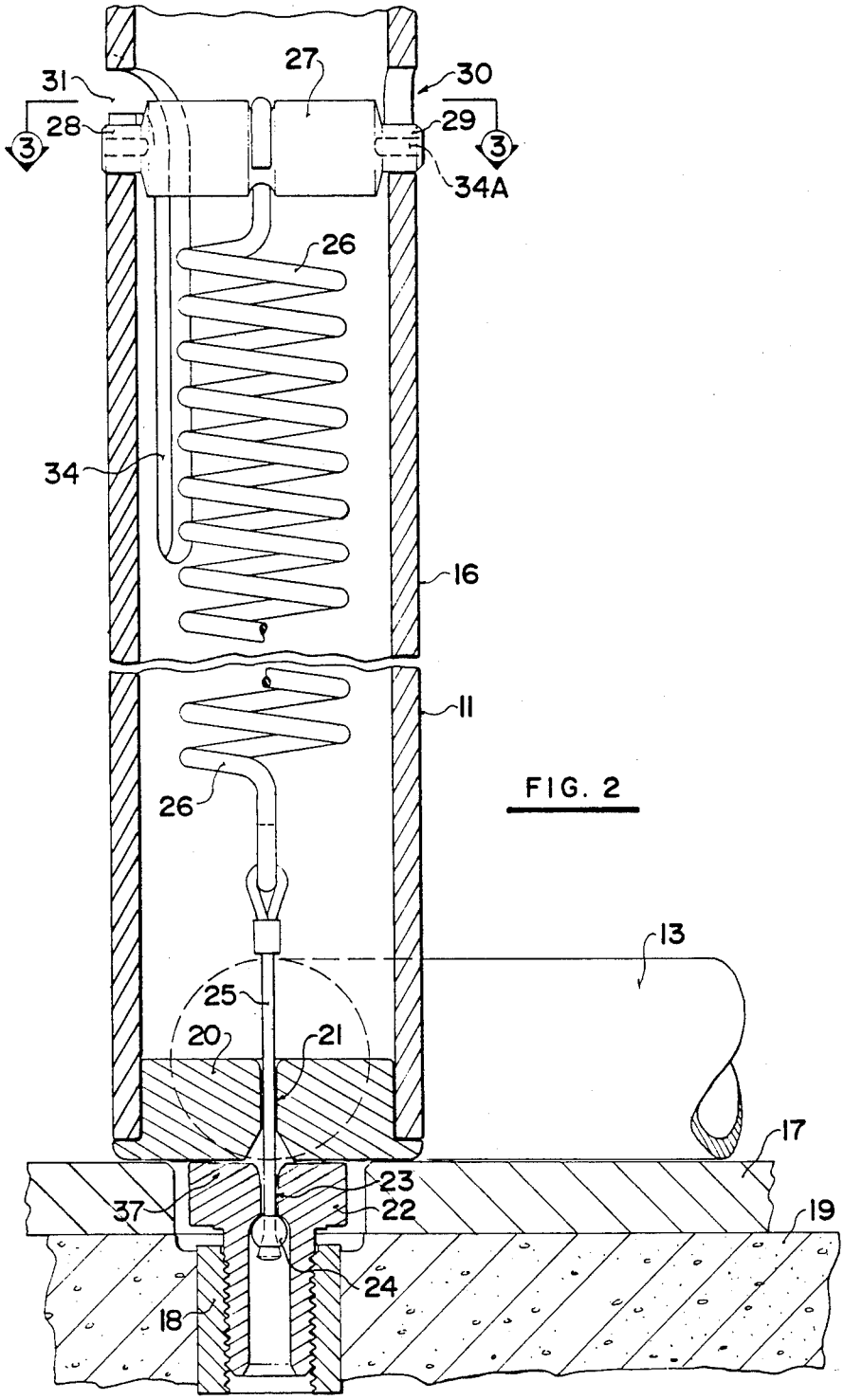
FIG. 2 is a longitudinal cross sectional view of one post of the net of FIG. 1.

Turning therefore to FIG. 2, the post 10 is formed from a hollow pipe with a cylindrical wall 16 upstanding from the ice surface indicated at 17. The conventional existing anchor nut is illustrated at 18 mounted in the concrete floor 19.

The lower end of the post is closed by a guide block 20 which has a central axial aperture 21.

A rigid anchor bolt 22 is provided which can screw into the nut 18 and includes a bore 23 for receiving a nipple 24 of a flexible attachment cable 25. The cable 25 is attached to one end of a spring 26 which comprises a coiled tension spring. The other end of the spring 26 is attached to a transverse pin 27 which extends across the post 10 and has ends 28 and 29 which are received in slots 30 and 31 in the wall 16 of the post 10.

The shape of the slots 30 and 31 is shown in elevational view in FIG. 1 and it will be noted that the slots are both of walking stick shape providing an elongate section 34 extending longitudinally of the post and at the upper end of the elongate section a notch 33.

The end portions 28 and 29 of the transverse pin 27 are reduced in width so as to enter relatively narrow slots 30 and 31 and the outer extent of the ends 28 and 29 is confined to lie within the outer peripheral surface of the wall 16 so as not to project beyond the outer edge of the post 10. In addition, bores 34A are provided in the outer faces of the ends of the end portions 28 and 29 for receiving a tool by which the transverse pin 27 can be grasped for sliding in the slots 30 and 31.

In an initial rest position of the apparatus, the transverse pin rests at the bottom of the elongate portion 34 of the slots 30 and 31 so that the top of the spring is displaced downwardly toward the bottom of the post 10, 11. In this position, the flexible cable 25 is free to extend out through the guide block 20 without substantially tensioning the spring 26.

Figure 3:
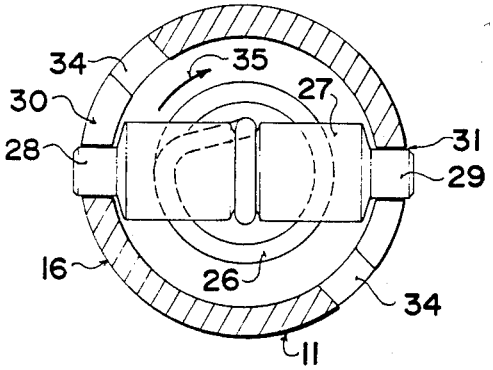
FIG. 3 is a cross sectional view along the lines 3—3 of FIG. 2.

Thus, the post can be positioned in the ice with the cable 25 pulled to one side of the post for attachment to the bolt 22 which can then be screwed into position into the concrete floor. At this stage, the pin 27 is grasped by the tool (not shown) which engages the bores 34A and is lifted by the tool upwardly along the slots to the top of the elongate portion 34 at which the pin 27 is turned angularly as shown in FIG. 3 by the arrow 35 so as to enter the notches 35 which act to retain the pin 27 at the upper position of the slots 30, 31. By this movement, the spring 26 is tensioned and any slack in the cable 25 is taken up so as to draw the post downwardly onto the pin 22.

The upper surface of the pin 22 is positioned at or below the level of the ice surface. In addition, the underside of the guide block is smooth so that the post is free to slide sideways over the ice and is not in any way inhibited in its movement by contact with the pin. The sideways sliding movement thus tensions the spring 26 and flexes the cable 25.

As soon as the force is withdrawn from the post, the spring 26 and cable 25 act to draw the post back to its normal position with the projection 36 and recess 37 acting again to locate the post in the exact required position.

An inner surface of the block 20 at the bore 21 and an outer edge of the block 20 at the base of the post 11 are both chamfered to avoid sharp edges which can cut the cable 25.

The screw coupling between the bolt 22 and the nut 18 can be replaced by a quick release coupling (not shown) so that the goal can be rapidly released to be removed for flooding the ice. A separate cap can be provided to cover the nut when the goal is removed during flooding to prevent ice formation over the nut.

Figure 4:
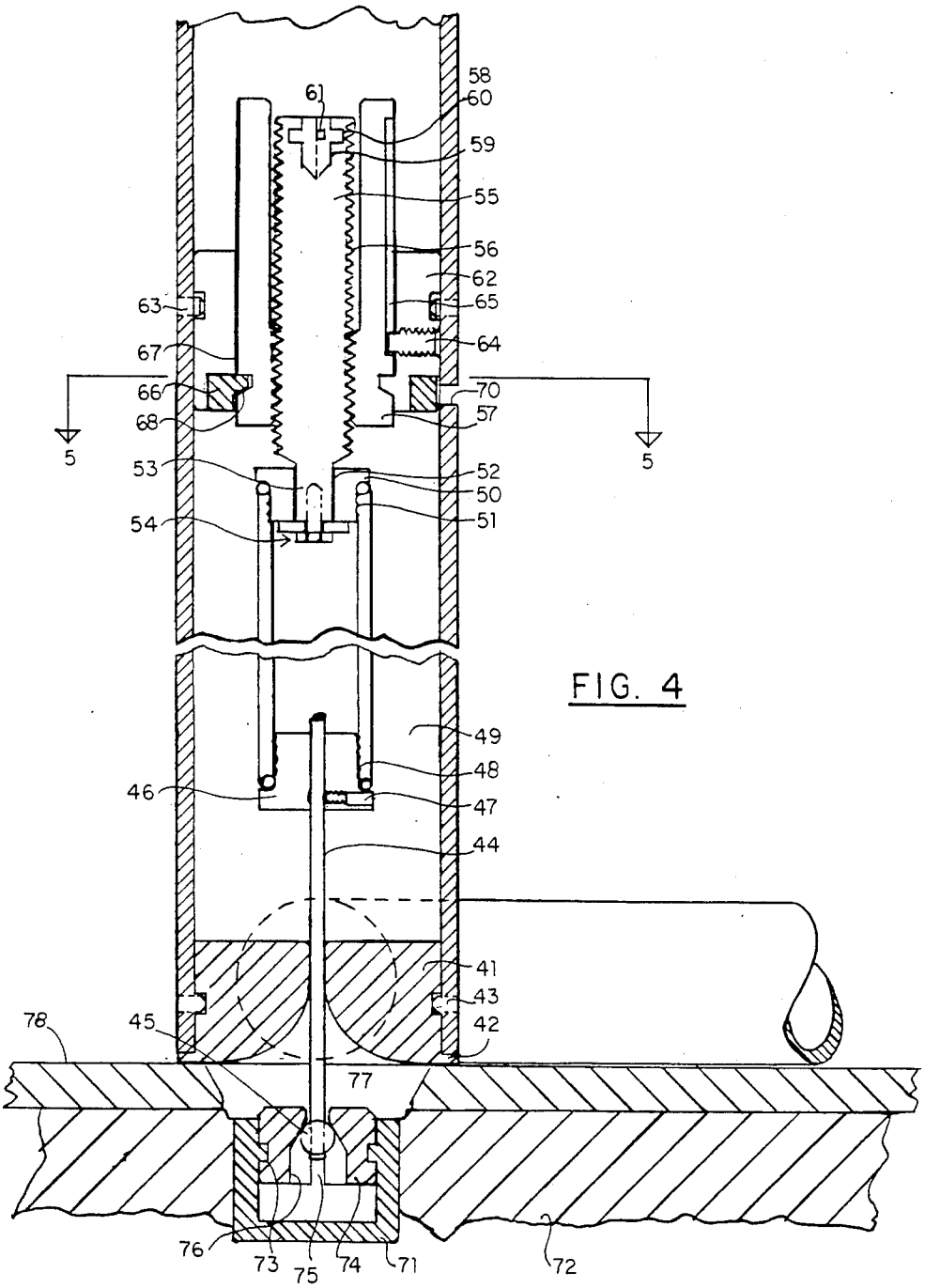
FIG. 4 is a part cross sectional side elevational view of one post including a modified attachment device.
Figure 5:
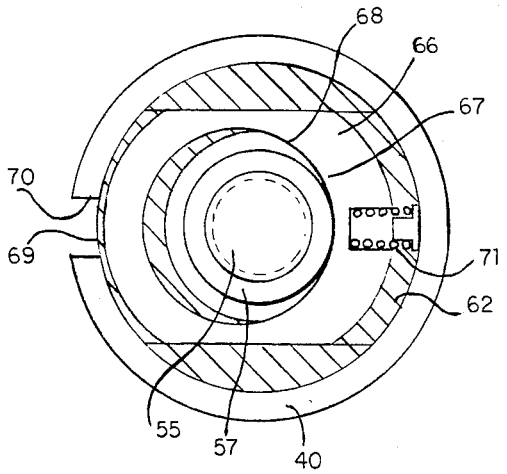
FIG. 5 is a view along the lines 5—5 of FIG. 4.

Turning now to the second embodiment illustrated in FIGS. 4 and 5, a post of a hockey goal net is indicated at 40. The post includes a guide block 41 at the lower end thereof which is formed from a plastics material and which is inserted into the lower end of the post with a flange 42 of the guide block acting to engage the lowermost end of the post and locate the guide block within the post. Set screws 43 are provided to retain the guide block within the lower end. A cable 44 passes through the guide block from an attachment nipple 45 at the lowermost end to an attachment member 46 at the upper end of the cable which can be clamped onto the cable by a set screw 47. The attachment member 46 includes a male screw thread portion 48 which is screwed into fixed engagement with the inner surface of a spring 49.

The upper end of the spring 49 is similarly attached to an attachment member 50 which has a male screw thread 51 again screwed into the interior of the spring so as to allow the remainder of the spring to flex between the two attachment members. The attachment member 50 has a central bore 52 which can rotate upon a pin 53 and is held in position on the pin by a washer and screw 54.

The pin 53 forms part of a elongated bar 55 which extends longitudinally and axially of the post 40. The bar 55 has on an outside surface thereof a screw thread 56 which cooperates with an inner screw thread of an outer sleeve member 57 so that the axial position of the bar 55 can be adjusted by rotating the bar within the inner screw thread so as to increase and decrease the tension in the spring 49. The rotation coupling between the attachment member 50 and the pin 53 allows the bar 55 to rotate in its adjustment movement. Adjustment of the bar 55 is provided by a tool which can be inserted into an opening 58 in an upper end of the bar 55. The opening comprises a cylindrical portion 59 and a counter bore portion 60 of increased diameter. The counter bore portion 60 defines a bayonet type fitting so that a crossbar of a tool clan be inserted though a slot in the upper face into the bore 60 and can rotate around the bore 60 to engage a stop 61 so that further rotation of the tool causes the bar 55 to rotate and adjust axially. In addition the bayonet type fitting defined between the tool and the recess allows the bar 55 to be grasped by the tool and pulled axially.

The outer sleeve 57 is slidably positioned within an outermost sleeve 62 which is itself attached to the inner surface of the post by set screws 63. A screw 64 projects inwardly from the inner surface of the outermost sleeve 62 to engage into a slot 65 provided in the outer surface of the outer sleeve to prevent the outer sleeve from rotating as the bar 55 is rotated in its adjustment movement. In addition the cooperation between the slot 65 and the screw 64 limits the axial sliding movement of the outer sleeve so that it can move from the position shown in FIG. 4 to a lowered position which will be apparent from inspection of the length of the slot 65 in which any tension in the spring is released and the cable 44 allowed to project without tension beyond the end of the guide block 41 to a length sufficient to allow the guide block and post to be moved to one side to expose the nipple 45.

A transversely slidably latch member 66 is supported in the outermost sleeve 62 so as to prevent axial movement of the latch member. The latch member is however slidably across the sleeve and is biased to a latched position by a spring 71 so that a portion 67 thereof engages a recess in the outer sleeve 57 to prevent the sleeve from moving axially. The portion 67 is formed as a circular bore so that movement sideways against the spring 71 of the latch member allows the circular outer sleeve 57 to drop through the bore indicated at 68 to the lowermost position. Sideways movement of the latch 66 is obtained by pressure against an outer surface 69 thereof exposed at an opening 70 in the post. The size of the opening 70 is small and is positioned inwardly and rearwardly of the post so as not in any way to interfere with contact with the post of a puck or other projectiles.

The tool (not shown) which cooperates with the opening 58 at the end of the, bar 55 can pass through a hole cut at the upper end of the post on the axis of the post as the post curves into the cross-bar. Again such a small opening does not interfere with the reaction between a puck and the goal structure.

Within the ice surface is provided a receptacle 71 which can be of a type which is permanently mounted in the concrete layer 72 or which is attached to the concrete layer by set screws applied from the top. An inner surface of the receptacle includes projections 73 which can cooperate with a coupling member 74. The coupling member 74 is formed in two parts split at a center line 75. The coupling member includes an inner bore 76 an upper portion 77 of which tapers inwardly so as to cooperate with the nipple 45 to retain it in position within the coupling member 74. The space between the two halves of the coupling member indicated at 75 is sufficient so that when the tension is released on the nipple 45 and the nipple is moved downwardly into the wider part of the inner bore 76, one part of the coupling member can be moved inwardly to a position where it is free from the projection 73 and can thus be withdrawn out of the receptacle 71. When that one half is withdrawn, the other half is also free to be withdrawn leaving the nipple 45 and the cable 44 totally free from the receptacle 71 so the post can be moved to one side.

In an alternative arrangement (not shown) the receptacle 71 is of the conventional type which includes an internal screw thread and the coupling member 74 has on the outer surface of each of the halves a cooperating screw thread so that when the two halves are forced outwardly by the nipple 45 the screw thread on the outer surface cooperates with the inner screw of the receptacle to retain the two halves within the receptacle.

It will be noted that the upper surface of the receptacle 71 on the upper surface of the coupling member 74 are well below the upper surface of the ice as indicated at 78. Thus the under surface of the guide block 41 sits on the ice surface around the opening within which the receptacle is positioned. The guide block is therefore free to slide sideways on the ice on impact on the post by a player providing sufficient force to overcome the resistance to movement generated by the spring and cable.

It has been found that the characteristics of this post mounting arrangement are such that the post is in fact free to slide sideways in a manner initially very similar to a free standing post following which the spring tension rapidly increases so when the impact is removed the post springs back to its initial position. This arrangement therefore provides immediate and soft deflection of the post when impacted following which the force gradually increases while the speed of the impacting player slows. This arrangement does therefore provide a very effective cushioning effect to reduce the danger of any injuries while allowing the post to be retained effectively in position and to spring back immediately to the required position without significantly interfering with the game.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A goal structure for attachment to an ice surface comprising a pair of vertical goal posts each having a hollow interior and arranged for attachment of a lower end thereof to the ice surface, a cross-bar rigidly interconnecting said goal posts at upper ends thereof in spaced upstanding position and a net support member extending rearwardly of and between the posts and rigidly attached to said lower ends thereof so that the goal structure defines a rigid body for supporting a net rearwardly of a face defined between the goal posts which can sit on the ice surface upon a base defined by the lower ends of the posts and an underside of said net support member, and a kit of parts for attachment of the goal structure to the ice surface, said kit comprising first and second spring means for mounting within the hollow interior of respective ones of said posts, first attachment means for attaching one end of each of said spring means within said goal post to the goal structure and second attachment means for attaching an opposed end of each of said spring means to the ice surface through the other end of the goal post, said second attachment means comprising a flexible cable having one end attached to the opposed end of the spring means, a receiving member for engagement in the ice surface, releasable fastening means attached to an opposed end of the cable and arranged for readily releasable engagement to said receiving member directly beneath said lower end of the post, and guide block means in said lower end of the goal post defining a narrow aperture through which the cable passes to said fastening means such that when attached, the spring means can apply spring tension between the goal post and the ice surface through the cable, said receiving member defining an upper surface which is at a height no greater than that of the ice surface and which is shaped such that the guide block means can move freely laterally thereto whereby a sufficient impact force on the goal post causes the goal post to move laterally relative to the ice surface and to pull said cable through said guide block means against spring tension.

2. The invention according to claim 1 including means for applying and releasing the spring tension whereby when released the goal post can be freely moved to expose said second attachment means.

3. The invention according to claim 2 wherein said applying and releasing means comprises latch means engageable with said first attachment and cooperable with the respective post to hold said first attachment means at a first position in the post and releasable to allow said first attachment means to move along the post to release the tension in the cable.

4. The invention according to claim 3 wherein said latch means is mounted inwardly of the post and is operable through an opening in the post to release said latch means and through a second opening in the post to reset said latch means.

5. The invention according to claim 1 wherein said guide block means provides a lowermost surface of the post which is free to slide across the ice.

6. The invention according to claim 1 wherein said releasable fastening means comprises an externally screw threaded member which can be engaged into an internally screw threaded receptacle within the ice surface.

7. The invention according to claim 1 wherein said releasable fastening means comprises a member formed in two halves and having an inner bore which converges toward an upper surface thereof such that a nipple on the end of the cable forces the two halves outwardly to engage an inner surface of a receptacle within the ice surface.

8. The invention according to claim 1 including a plug member for inserting into the ice surface in place of said releasable fastening means with said goal post removed from the ice so as to prevent water from entering said receiving member in the ice surface when the ice is flooded.

9. The invention according to claim 1 including screw thread means rotatable so as to provide axial adjustment of said first attachment means whereby to increase and decrease tension in the cable provided by said spring.

10. The invention according to claim 1 including manually actuable means for moving said first attachment means.

11. The invention according to claim 10 wherein said first attachment means comprises a block for fixing inside the post and having an axial screw threaded bore for receiving a threaded rod attached to said one end of said spring means.

* * * * *